United States Patent [19]

Kooi et al.

[11] 4,279,604

[45] Jul. 21, 1981

[54] FORK TRUCK

[75] Inventors: Hessel Kooi, Vrouwenparochie; Hendrik de Vries, No. 28, Hemmemaweg, St. Annaparochie, both of Netherlands

[73] Assignees: Kooi B.V., Vrouwenparochie; de Vries, Hendrik, St. Annaparochie, both of Netherlands

[21] Appl. No.: 48,524

[22] Filed: Jun. 14, 1979

[30] Foreign Application Priority Data

Jun. 23, 1978 [NL] Netherlands ..... 7806778

[51] Int. Cl.[3] ..... B66F 9/06

[52] U.S. Cl. ..... 414/667; 180/215; 280/755

[58] Field of Search ..... 414/631–633, 414/663–667, 673; 280/755, 35, 638; 180/209, 215

[56] References Cited

U.S. PATENT DOCUMENTS

| | | | |
|---|---|---|---|
| 2,618,396 | 11/1952 | Belt | 414/633 |
| 2,986,295 | 5/1961 | Shaffer | 280/755 X |
| 3,490,633 | 1/1970 | Avis et al. | 414/631 X |

FOREIGN PATENT DOCUMENTS

| | | | |
|---|---|---|---|
| 748320 | 12/1966 | Canada | 414/667 |
| 1431701 | 11/1968 | Fed. Rep. of Germany | 414/633 |
| 1431787 | 7/1969 | Fed. Rep. of Germany | 414/631 |
| 7802053 | 8/1979 | Netherlands | 414/663 |

*Primary Examiner*—Leslie J. Paperner
*Assistant Examiner*—Terrance L. Siemens
*Attorney, Agent, or Firm*—John P. Snyder

[57] ABSTRACT

A fork lift truck having a frame provided with widely spaced forward supporting wheel points is directly supported on the ground through a laterally shiftable mast at a third supporting point which shifts with the mast so that increased stability is obtained.

5 Claims, 3 Drawing Figures

FORK TRUCK

The invention relates to a fork truck comprising a frame, a mast arranged on a carrier device on said frame and adapted to tilt forwards and backwards, means for tilting the mast, a load carrier movable up and down along the mast, means for moving said load carrier up and down, guide means for guiding the carrier device and the mast in a lateral direction and means for driving the carrier device in a lateral direction, the frame being supported by three supporting elements, two of which are formed by wheels rotatably arranged on an axle arranged transversely of the normal direction of travel. A fork truck of this kind is known from Dutch patent application No. 75.00710. Such a fork truck can be transported on the rear side of a van and be employed on the loading or unloading site thanks to its own drive for loading or unloading the van. As a matter of course the weight of the fork truck should be low. The consequence thereof is that in contrast to the conventional fork truck, which is built with utmost compactness with regard to manoeuvrability, the disposition of the supporting elements has to be chosen so that the load is invariably lying within the imaginary triangle, the corners of which are formed by the supporting elements. In normal fork trucks the centre of gravity of the load is lying outside the supporting elements, so that counterweights are required for obtaining the desired stability. In quite particular circumstances, for example, in the event of a load projecting over a large distance and of uneven soil, the centre of gravity of the load may get beyond the imaginary triangle so that with respect to the tilting line formed by the line of connection between two supporting points a moment is produced as a result of which the fork truck may topple over.

The invention has for its object to eliminate this risk. According to the invention this is achieved in that the third supporting element is disposed outside of and, viewed in the direction of travel, behind the axis defined by the other two supporting elements and is coupled with the carrying device. It is thus ensured that the third supporting element always moves together with the laterally displaceable carrier device. The corner of the imaginary triangle formed by the third supporting element thus shifts in place with the load, as a result of which the centre of gravity of the load will invariably lie within the shifting triangle.

In order to further enhance stability the supporting element may be guided in a guide arranged transversely of the direction of movement and provided at the ends with caster wheels. Thus on a four-wheeled underframe a three-point support is obtained so that on any form of the ground a satisfactory stability is ensured. The supporting element may be a rotatable roller. In a further embodiment the supporting element may be a sliding member. The caster wheels may be driven. A stable fork truck according to the invention permits of mounting thereon a seat for the operator as well as an instrument panel.

The invention will be described more fully with reference to the embodiments shown in the drawing.

Figure 1:
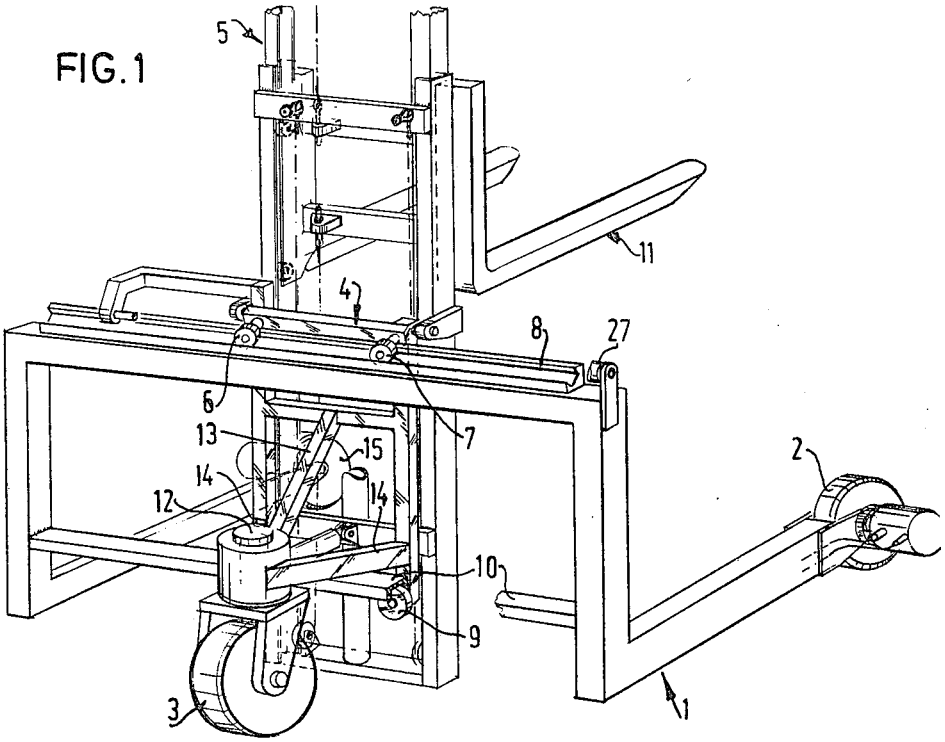
FIG. 1 is a perspective view of a first embodiment of the invention.

The fork truck comprises a frame 1 having front wheels 2 and 15 and a caster rear wheel 3. On the frame the carrying device 4 with the mast 5 is adapted to reciprocate transversely of the direction of travel. The movement is controlled by rollers 6,7 in the guide rail 8 and by rollers 9 in the guide beam 10. The mast 5 guides the fork lift 11. The parts mentioned above are of known structure and need therefore not be described in detail. The caster wheel 3 is adapted to rotate about the axis of the axle 12. According to the invention the caster wheel 3 is coupled by the beams 13 and 14 with the carrying device 4 and will, therefore, move with the transverse movement of the carrying device. As a result the imaginary triangle, the corners of which are formed by the wheels 2,3, and 15, has a fixed base formed by the line of connection between the wheels 2 and 13, whereas the apex formed by the wheel 3 always moves together with the load. This results in that the tilting lines of the load present on the fork truck formed by the lines of connection between the wheels 2,3 and 3,15 respectively shift in place with the displacement of the load so that the load will invariably lie within said imaginary triangle. In this way a stable array is obtained. With a transverse displacement the caster wheel 3 will, of course, be displaced through an angle of 90° with respect to the position shown.

Figure 2:
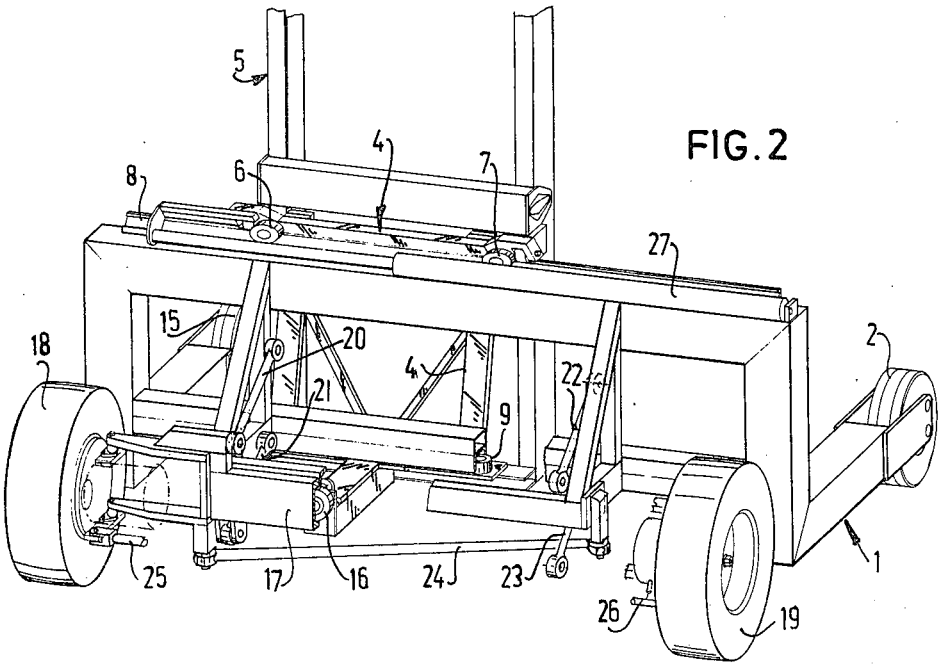
FIG. 2 shows perspectively a second embodiment of the invention.
Figure 3:
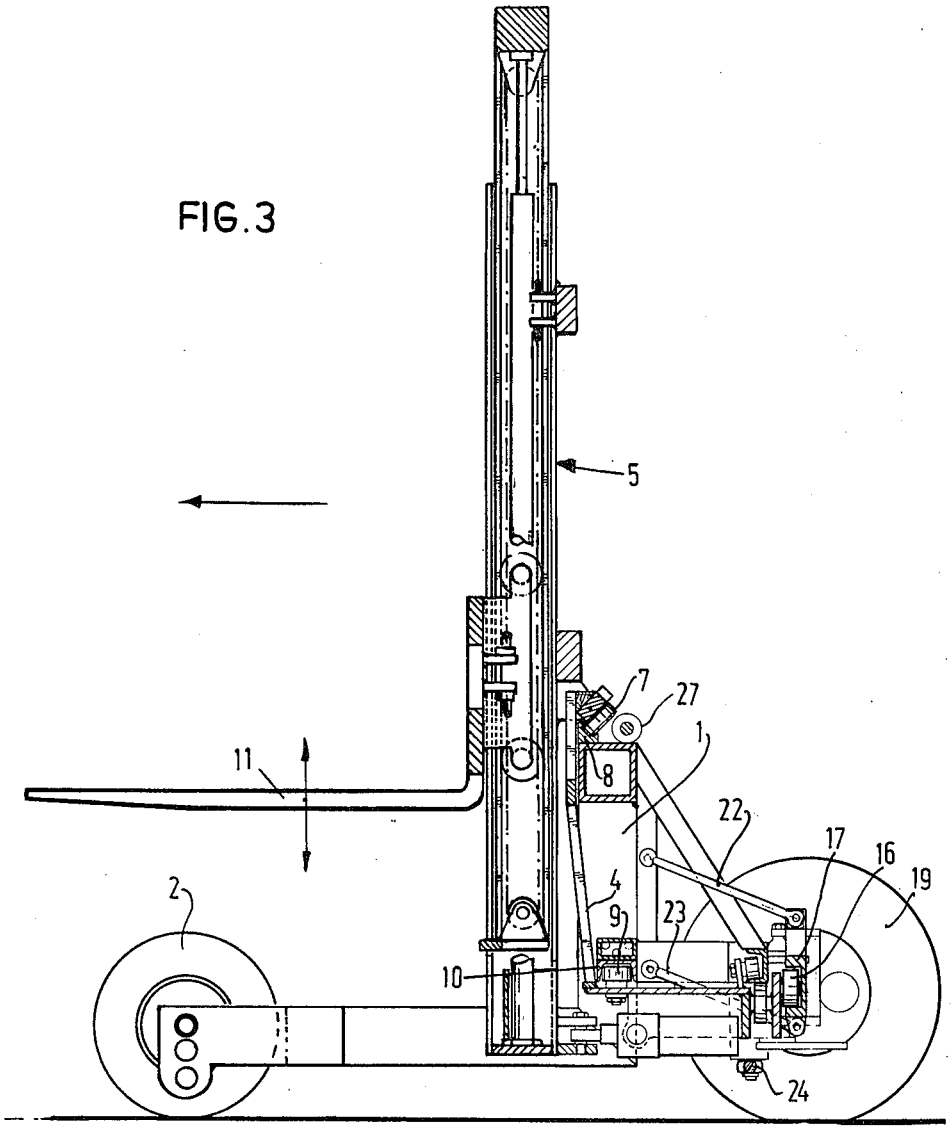
FIG. 3 is a longitudinal sectional view of the embodiment shown in FIG. 2.

In the embodiment shown in FIG. 2 the wheel 3 rolling along the ground is replaced by a roller 16, which moves in a guide beam 17, the ends of which are provided with ground-engaging wheels 18 and 19. It will be appreciated that the guide beam 17 with its wheels 18 and 19 forms a unit separate from the frame 1 with its wheels 2 and 15. However, the guide beam 17 is attached to the frame by the two sets of trailing links 20,21 and 22,23 and is laterally stabilized by the transverse link 24. In this way, the guide beam 17 can rock to allow the two wheels 18 and 19 to share the load imposed upon the beam 17 even if the ground surface is uneven. In this respect, it will be noted from FIGS. 2 and 3 that the weight of the frame plus that weight transmitted to the frame by the mast 5, is transmitted to the guide beam 17 through the single roller 16. Thus, whatever the lateral location of the roller 16 (due to the lateral position of the mast), the beam can rock about the axis of such roller because of the links 20, 21 and 22,23. The wheels 18 and 19 are driven and steered by means of the steering rods 25 and 26. The drive of the carrying device 4 is obtained with the aid of the piston-cylinder combination 27. Otherwise the construction is largely identical to that of FIG. 1 so that a description in detail may be omitted.

What we claim is:

1. In a fork lift truck of the type having a frame provided with a pair of laterally spaced ground engaging wheels at the forward end thereof defining respective forwardly disposed supporting points;

mast assembly means movably mounted on said frame in spaced relation behind said wheels for lateral shifting relative to said frame, said mast assembly means including an upright mast, a load carrier vertically movable on said mast and projecting forwardly therefrom and means for vertically moving said load carrier, and means for laterally shifting said mast assembly means on said frame, the improvement which comprises:

ground engaging wheel means disposed behind said mast assembly means for supporting said frame and mast assembly means, through said mast assembly means, at a third support point which defines the apex of an imaginary triangle of which the base is defined between said forwardly disposed supporting points and within the plan view area of which imaginary triangle the center of gravity of the fork lift truck and a load supported by said load carrier must remain in order to prevent tipping of the truck, said ground engaging wheel means including force transferring means carried by said mast assembly means and constituting said third support point whereby said apex is laterally shiftable with the mast assembly means.

2. In a fork lift truck as defined in claim 1 wherein said ground engaging wheel means comprises a caster wheel having an upstanding axle and said force transferring means rotatably supports said axle whereby said caster wheel shifts laterally with said mast assembly means.

3. In a fork lift truck as defined in claim 1 wherein said ground engaging wheel means comprises a guide beam extending laterally of said frame and having ground engaging wheels at its opposite ends and means connecting said guide beam to said frame for allowing the guide beam to rock relative thereto, and said force transferring means bearing upon said guide beam at said third support point therealong as determined by the lateral position of said mast assembly means.

4. A fork lift truck comprising, in combination:

a frame having a pair of widely spaced ground engaging wheels defining a pair of support points which constitute the sole direct support between said frame and the ground;

an upright mast assembly movably supported on said frame along a transverse path generally parallel to a line joining said support points and spaced therefrom;

a load carrier vertically movable on said mast assembly and extending in a direction toward but between said wheels;

means for raising and lowering said load carrier;

means for moving said mast assembly along said transverse path; and ground engaging wheel means for supporting said frame indirectly through said mast assembly at a third support point which shifts laterally with said mast assembly.

5. A fork lift truck comprising, in combination:

a frame having a pair of widely spaced ground engaging wheels defining a pair of support points which constitute the sole direct support between said frame and the ground;

an upright mast assembly movable supported on said frame along a transverse path generally parallel to a line joining said support points and spaced therefrom;

a load carrier vertically movable on said mast assembly and extending in a direction toward, but between said wheels;

means for raising and lowering said load carrier;

means for moving said mast assembly along said transverse path; and further frame support means carried by and laterally shifted with said mast assembly for supporting the frame from the ground.

* * * * *